US006684937B2

(12) United States Patent
Lenz et al.

(10) Patent No.: US 6,684,937 B2
(45) Date of Patent: Feb. 3, 2004

(54) MODULE CARRIER FOR VARIOUS HEAT EXCHANGERS FOR A MOTOR VEHICLE ENGINE

(75) Inventors: Werner Lenz, Mühlacker (DE); Anette Baumann-Kaiser, Marbach/Neckar (DE); Oliver Braun, Ostifildern (DE); Martin Brielmair, Erding (DE)

(73) Assignees: Behr GmbH & Co., Stuttgart (DE); Bayerische Motoren Werke AG, Munich (DE)

( * ) Notice: Subject to any disclaimer, the term of this patent is extended or adjusted under 35 U.S.C. 154(b) by 238 days.

(21) Appl. No.: 10/002,628

(22) Filed: Dec. 5, 2001

(65) Prior Publication Data

US 2002/0070003 A1 Jun. 13, 2002

(30) Foreign Application Priority Data

Dec. 7, 2000 (DE) ..... 100 61 561

(51) Int. Cl.[7] ..... B60H 1/24

(52) U.S. Cl. ..... 165/41; 165/67; 165/69; 165/78; 165/149; 180/68.4

(58) Field of Search ..... 165/41, 67, 69, 165/78, 149; 180/68.4

(56) References Cited

U.S. PATENT DOCUMENTS

| | | | | |
|---|---|---|---|---|
| 4,315,540 A | * | 2/1982 | Moranne | 165/67 |
| 6,073,594 A | * | 6/2000 | Tsukiana et al. | 123/41.33 |
| 6,470,961 B1 | * | 10/2002 | Case | 165/78 |

FOREIGN PATENT DOCUMENTS

| | | |
|---|---|---|
| DE | 39 16 777 | 4/1990 |
| DE | 39 22 814 | 4/1990 |
| DE | U 91 14 734 | 3/1992 |
| DE | 198 31 256 | 1/2000 |

* cited by examiner

*Primary Examiner*—Terrell Mckinnon
(74) *Attorney, Agent, or Firm*—Foley & Lardner

(57) ABSTRACT

A description is given of a module carrier for various diverse heat exchangers for a motor vehicle engine, which comprises a supporting frame, to which the coolant/air cooler and at least one air-conditioning condenser is fitted. The supporting frame comprises a lower part with a crossmember 2 as base and two side parts 3, 4 projecting vertically therefrom, to define upwardly open compartments 6, 7, 6', 7' in the lower part for the insertion of at least the coolant/air cooler and the air-conditioning condenser 9. These upwardly open compartments are closed off by an upper support 5, which interconnects the free ends of the side parts 3, 4 to form the supporting frame and which secures the inserted heat exchangers 8, 9 in their positions.

14 Claims, 3 Drawing Sheets

MODULE CARRIER FOR VARIOUS HEAT EXCHANGERS FOR A MOTOR VEHICLE ENGINE

CROSS-REFERENCE TO RELATED PATENT APPLICATIONS

Priority is claimed based upon German Patent Application No. 100 61 561.9, filed Dec. 7, 2000, which is incorporated herein by reference in its entirety, including the specification, drawings, claims and abstract.

BACKGROUND OF THE INVENTION

The present invention relates to a module carrier for various, multiple, different heat exchangers for a motor vehicle engine.

A module carrier of this general type is disclosed by DE 198 31 256 A1. There, in a crossmember which is part of the front area of a motor vehicle, a U-shaped area is provided, and into this U-shaped area is inserted a rectangular frame, which consists in particular of plastic and is inserted in a form-fitting manner. This frame has an upwardly open U-shaped part, into which a cooler and a condenser can be inserted in the manner of drawers. These two inserted parts are then held in the frame by a top plate, which also holds the frame in the U-shaped area of the crossmember. The frame projects forward in the direction of travel beyond the inserted heat exchangers and forms an air guide frame. This configuration makes the arrangement of a closed insertion frame necessary and is therefore relatively complicated.

DE-U 91 14 734 discloses a module carrier in which a supporting frame injection-molded in one piece from plastic is provided for two fans driven by an electric motor. A bracket projects in an L shape on one side, and on this bracket the coolant/air cooler can be placed at a distance from the supporting frame, and connected to the plastic frame by supporting arms, which bridge the distance between the supporting frame and the installed coolant/air cooler. A condenser can be inserted into the interspace between coolant/air cooler and supporting frame, and is at the same time held by the supporting arms of the bracket. In addition, possible mounts for an oil cooler and for a fan shroud are also provided there. This known module carrier certainly simplifies the installation and removal of the various elements, even in the case of a repair, but because of its relatively complicated construction, it is very expensive.

DE 39 22 814 A1 discloses another type of mounting for the cooler of a motor vehicle engine. In this design a coolant/air cooler equipped with only one water reservoir and with U-shaped pipes is provided, which can be inserted in the manner of a cassette into a duct-like opening formed within the mounting. In addition, by using conventional means, an oil cooler can be fitted underneath this mounting, and a condenser can likewise be screwed to one side wall. In order to remove these additional parts, it is necessary to dismantle the mounting from the vehicle. This also applies in the case of removal of the water/air cooler inserted into the mounting.

Finally, DE 39 16 777 A1 also discloses a mounting for a fan shroud, which can be incorporated into the vehicle. When, for the purpose of making a repair, it is necessary to dismantle the water/air cooler, which is provided with two water reservoirs, the mounting has to be removed from the vehicle. This is because the water/air cooler, with its side parts, is inserted into the frame-like mounting provided there, and therefore has to be fixed both to the lower and to the upper water reservoir.

SUMMARY OF THE INVENTION

The primary object of the present invention is to provide a module carrier of the type described above having a simpler construction and a more advantageous mode of use.

In accomplishing this and other objects of the invention, there has been provided according to one aspect of the invention a module carrier for multiple heat exchangers for a motor vehicle engine, comprising: a supporting frame adapted for installation in a vehicle forward area, the supporting frame comprising (a) a lower part, (b) two side parts projecting vertically from the lower part, the side parts and the lower part defining a plurality of compartments open on one side for the insertion of at least a coolant/air cooler and a air-conditioning condenser, and (c) a closure part, for securing the inserted heat exchangers in their positions, wherein the closure part comprises a support member connecting the side parts together and including mounting devices for an oil cooler.

In accordance with another aspect of the invention, there has been provided a cooling module for use in a vehicle having a heat-generating power plant, a fan driven by the power plant and a forward grille, the cooling module comprising: a carrier module as defined above; and a fan shroud attached to attachment members on the module carrier, for surrounding the fan, wherein the construction enables use of a duct extending from the grille to the fan shroud for preventing air from bypassing the module.

According to still another aspect of the invention, there has been provided a motor vehicle having a heat-generating power plant, a fan driven by the power plant, a forward grille, a cooling module comprising a carrier module as defined above; a coolant/air cooler and an air-conditioning condenser mounted in the carrier module; and a fan shroud attached to attachment members on the module carrier, for surrounding the fan.

Further objects, features and advantages of the present invention will become apparent from the detailed description of preferred embodiments that follows, when considered together with the accompanying figures of drawing.

BRIEF DESCRIPTION OF THE DRAWINGS

The invention is illustrated in the drawings by using an exemplary embodiment and will be explained below. In the drawings.

DETAILED DESCRIPTION OF THE PREFERRED EMBODIMENTS

Figure 1:
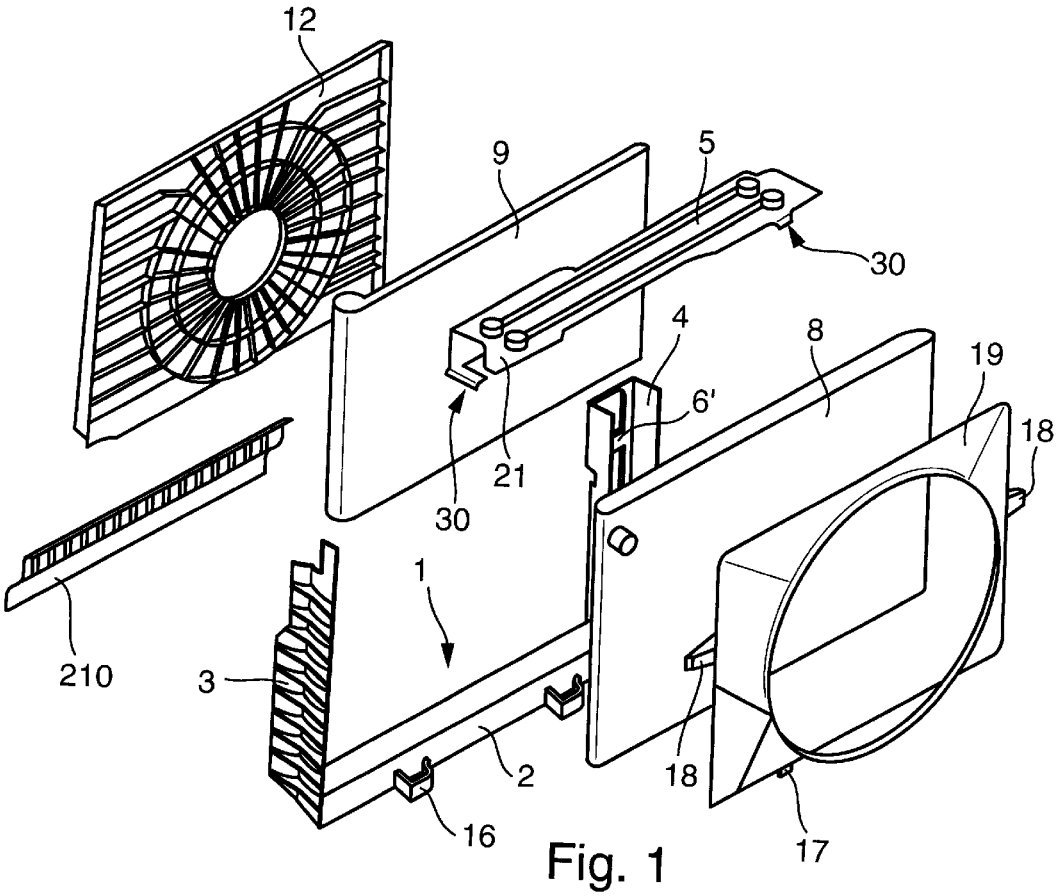
FIG. 1 is a schematic perspective exploded view illustrating the module carrier according to the invention with its individual parts.

According to the present invention, a module carrier of the type described above is provided with a closure part that is constructed as a stable carrier, which connects the side parts to the supporting frame and is also provided with holding devices for an oil cooler.

This configuration brings with it the significant advantage that a supporting frame is produced that can be inserted directly into the vehicle and is not bound to a corresponding previous construction. All the individual components present in the module carrier can be pulled out upwardly in a simple manner after the upper crossmember, which forms a kind of cover, has been loosened. Thus, during the removal or installation of one of the parts of the cooler module, firstly, the supporting frame remains in the vehicle and, secondly, the other parts can remain completely untouched. The coolant circuit, refrigerant circuit and oil circuits, if oil coolers are present, are independent of one another, so that even when a fluid system has to be interrupted in the event of service, for example, the coolant circuit for the coolant/air cooler and the other fluid systems remain untouched, for example, the refrigerant and oil circuits.

This configuration brings with it the further advantage that the geometry of the vertically projecting side parts in the area of the coolant/air cooler and of the air-conditioning condenser can be configured in such a way that a labyrinth system is formed, which prevents air flowing around the two heat exchangers, both in and counter to the direction of travel. Furthermore, the heat exchanger components are sealed off all around against leaking air.

In addition, the configuration of the module carrier in the front area makes it possible for the vehicle manufacturer to use a duct which runs to the vehicle front grille and which seals off the complete module against air flowing around it.

In one preferred embodiment of the invention, the upper support, serving as a cover, on the side facing the compartments, can be provided with resilient compensation elements to make contact with the heat exchangers inserted into the compartments. This configuration results in secure anchoring of the individual heat exchangers.

In a further advantageous embodiment, the oil cooler, if one is provided, can be arranged directly on the inner side of the upper support, specifically in such a way that it does not hamper the closure of the insertion compartments by the resilient elements. This configuration brings with it the advantage that, in order to remove the oil cooler, only the upper crossmember, acting as a cover, has to be removed. No dismantling of the other mounting parts or other heat exchangers is therefore necessary.

In a further preferred embodiment of the invention, the crossmember acting as a cover and the side parts can be provided with fixing elements for mounting in the vehicle. It is possible for the fixing elements on the crossmember to be constructed as fixing screws which act approximately vertically on the latter and are provided with a contact end made of elastomeric threads. These fixing screws can therefore be screwed from above in the direction of the crossmember through a support located in the vehicle, until their lower ends rest resiliently in corresponding seats on the crossmember and, in this way, perform the securing of the module carrier in the vehicle, especially against acceleration forces which occur.

The fixing elements on the side parts are constructed in a manner known per se, as laterally projecting bearing blocks having resilient blocks.

In a further embodiment of the invention, an insertion compartment for a blower frame for a fan driven by an electric motor can also be provided in the supporting frame. In addition, possible attachments for a fan shroud can be provided, preferably on the side facing away from the blower frame for the fan driven by the electric motor. It is also possible for a power-steering cooler to be provided in the area of the crossmember that is constructed as a base.

In another embodiment of the invention, in a variation of the supporting frame, a charge-air/air cooler can be arranged in an additional integrally-molded compartment, in the lower area. The geometry of the compartment prevents air flowing around the charge-air/air cooler both in and counter to the direction of travel.

Figure 2:
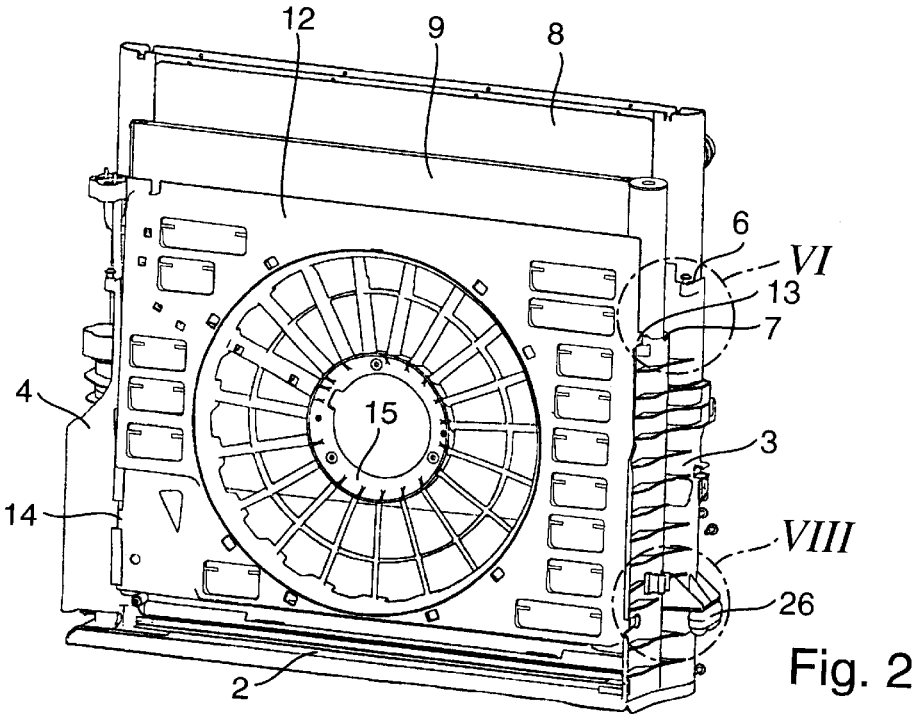
FIG. 2 is a perspective view of the module carrier in the assembled state according to FIG. 1, but without the upper cover support in place.

It is understood from FIGS. 1 and 2 that the module carrier for various diverse heat exchangers for cooling a motor vehicle engine in the exemplary embodiment shown is constructed from a supporting frame, comprising a U-shaped lower part 1 with a crossmember 2 as base, and two side parts 3 and 4 projecting upwardly from this crossmember. The lower part 1 is closed to form a frame by an upper support 5, which interconnects the two free ends of the side parts 3 and 4.

Figure 3:
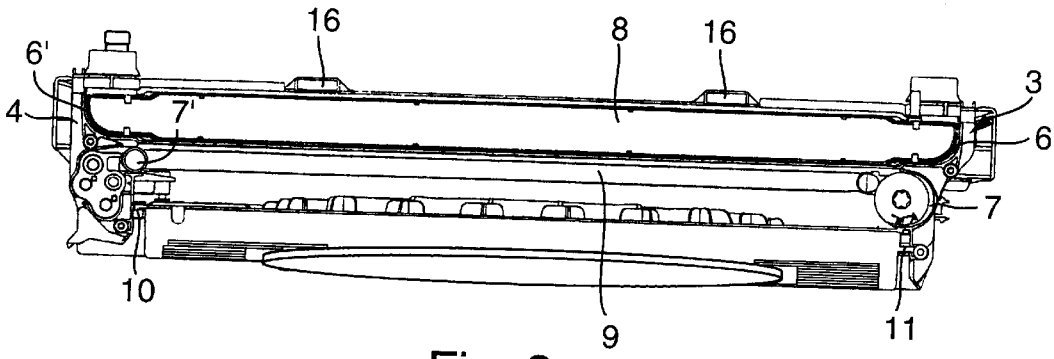
FIG. 3 is the plan view of the module carrier according to FIG. 1.

Formed in the lower part 1 (in the side parts 3 and 4 and in the base 2) are insertion grooves 6 and 7 (see also FIG. 3). The groove contours 6, 6' and 7, 7' extending along the side parts 3 and 4 in each case correspond to the outer contours of a coolant/air cooler 8 of known design and of an air-conditioning condenser 9 and define compartments for the heat exchangers. The upper support 5, serving as a cover, on the side facing the compartments can be provided with resilient compensation elements 30 to make contact with the heat exchangers inserted into the compartments.

The side walls 3 and 4 are also provided with insertion slots 10 and 11 for guide lugs belonging to a blower frame 12 which, at its center, has a mounting ring 15 for an electric motor (not shown) for driving a fan. This blower frame 12 is provided with lateral lugs 13 and 14 and engages with the latter in the slot-like guides 10 and 11 (FIG. 3). In this way, the blower frame 12 is held parallel to the condenser 9 and to the coolant/air cooler 8.

For better clarity, FIG. 2 shows the air-conditioning condenser 9 and the coolant/air cooler 8 in the state in which they have not yet been inserted completely into the guides 6 and 7. However, it can clearly be seen that both heat exchangers can be pulled out of the supporting frame 1, in the direction facing away from the bottom crossmember 2, and out of the lateral guides 6, 7 in the side parts 3 and 4. The same is true of the blower frame 12.

The bottom crossmember 2 in the exemplary embodiment is provided with two plug-in lugs 16, which are used to accommodate plug-in pins 17 belonging to a frame 19 which, with lateral holding lugs 18, latches into receptacles, not specifically shown, on the side parts 3 and 4. The mounting, comprising the upper crossmember 5 and the U-shaped supporting frame, can therefore accommodate the coolant/air cooler 8, the air-conditioning condenser 9, the blower frame 12 for a fan driven by an electric motor and the shroud 19 surrounding the fan driven by the motor, as can be seen schematically in FIG. 1. All these parts are then held by the upper crossmember 5, when it is put in place, which in addition supplements the U-shaped lower part 1 to form a stable frame.

Figure 4:
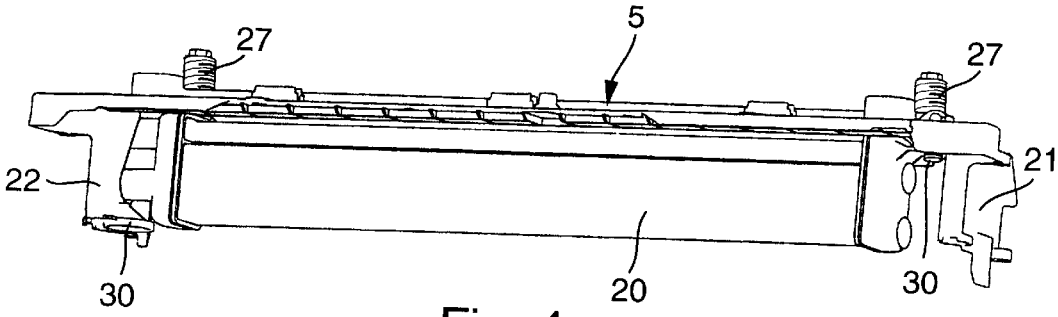
FIG. 4 is a perspective view illustrating the upper crossmember, missing from FIG. 2, with an oil cooler attached.

FIG. 1 also shows that this upper, cover-like crossmember 5—in this regard see also FIG. 4—can be provided with an oil cooler 20, which is fitted on its underside in such a way that there is still space for it above the air-conditioning condenser 9, without the closure function of the upper crossmember 5 being impaired. This is because the upper crossmember 5 can be provided, on the side facing the compartment defined by contours 6, 7, 6', 7', with resilient compensating elements, which come into contact with the heat exchangers 8 and 9 inserted into the compartments. According to FIG. 1, it is also possible to provide the option, for example, of additionally fitting a power-steering cooler 31 at the bottom in the area of the bottom crossmember 2, should this be desired.

Figure 5:
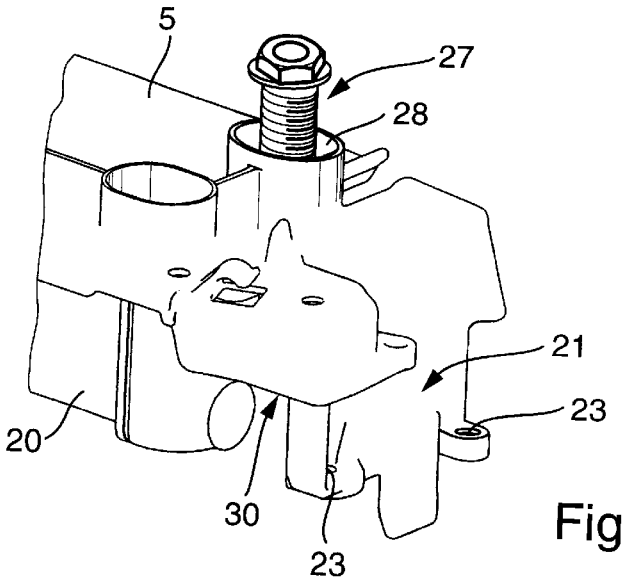
FIG. 5 is an enlarged perspective illustration of the right-hand end of the support according to FIG. 4.
Figure 6:
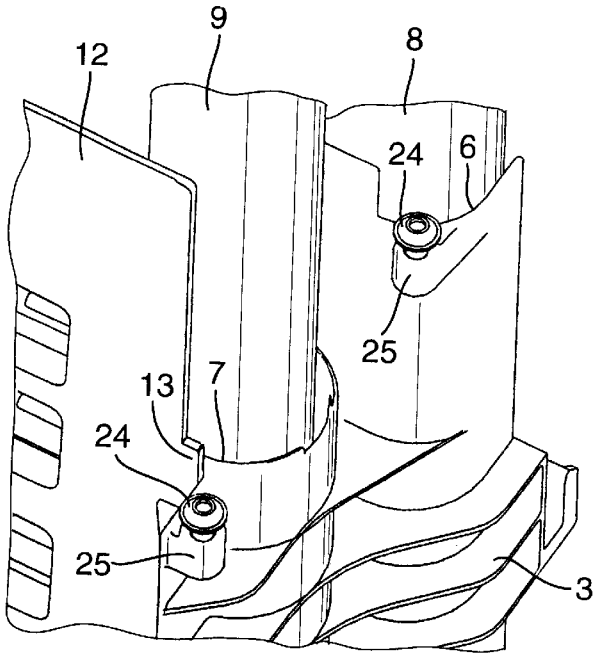
FIG. 6 is an enlarged illustration of the individual part VI in FIG. 2.
Figure 7:
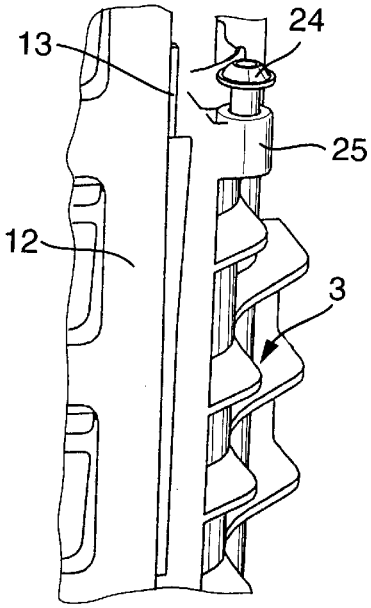
FIG. 7 is another view of the detail according to FIG. 6.
Figure 8:
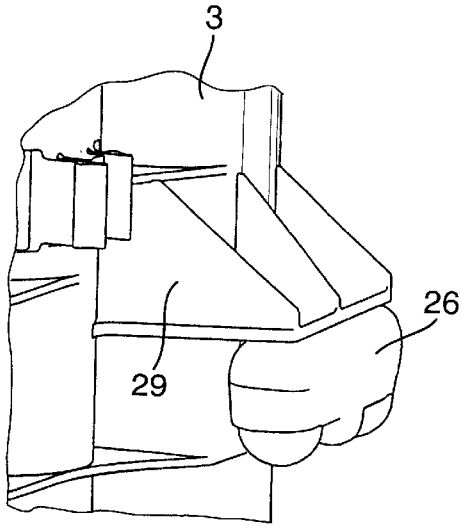
FIG. 8 is an enlarged perspective illustration of the detail VIII according to FIG. 2.

FIGS. 4 and 5 show that the upper crossmember 5, at both its ends, is provided with downwardly projecting attachments 21 and 22, which are provided with fixing lugs with openings 23, through which the screws 24 (FIGS. 6 and 7) can be pushed and then fixed in corresponding threaded lugs 25 belonging to the side parts 3 and 4. The entire module carrier is then supported laterally in the vehicle via resilient buffer elements 26 which are known per se and are fitted to lateral supporting lugs 29. The module carrier is held from above by means of screws 27 which, in the area subsequently facing the crossmember 5, have threads produced from elastomer. These screws 27 are screwed into holding seats 28 on the upper side of the crossmember 5 and, in a manner not specifically shown, pass through a crossmember in the vehicle, through which they are screwed downwardly until their resilient attachment comes into contact with the holding seats 28. The module carrier is therefore resiliently supported laterally on the buffers 26 and likewise secured resiliently from above.

The great advantage of this mounting, which can be arranged in a very straightforward way in the vehicle, is that, in the event of service or in the event of a repair, the relevant heat exchanger. For example, the coolant/air cooler 8, can be pulled out upwardly in a simple way after the upper crossmember 5 has been loosened, without the other heat exchangers being influenced thereby. For example, the existing oil cooler 20 is also removed by removing the crossmember 5. Its feed and return lines, since they generally have sufficient flexibility, do not need to be unclamped. The same applies to the air-conditioning condenser 5 that remains in the mounting, and also to the other parts fitted to the module carrier.

It is to be understood that various obvious modifications can be made to the preferred embodiments illustrated and described above, and it is intended that the invention not be limited to those disclosed embodiments. The claims are intended to cover the invention broadly, included its obvious equivalent.

What is claimed is:

1. A module carrier for multiple heat exchangers for a motor vehicle engine, comprising:

a supporting frame adapted for installation in a vehicle forward area, said supporting frame comprising (a) a lower part, (b) two side parts projecting vertically from the lower part, the side parts and the lower part defining a plurality of compartments open on one side for the insertion of at least a coolant/air cooler and a air-conditioning condenser, and (c) a closure part, for securing the inserted heat exchangers in their positions, wherein the closure part comprises a support member connecting the side parts together and including mounting devices for an oil cooler.

2. A module carrier as claimed in claim 1, wherein the support member includes, on the side facing the compartments, projecting attachment members and resilient compensating elements to make contact with the heat exchangers inserted into the compartments.

3. A module carrier as claimed in claim 1, wherein the support member and the side parts include plural mounting elements for mounting the module carrier in a vehicle.

4. A module carrier as claimed in claim 3, wherein the mounting elements on the support member comprise fixing screws acting approximately vertically on the support member and having a contact end which has threads made of an elastomer.

5. A module carrier as claimed in claim 3, wherein the mounting elements on the side parts comprise bearing blocks that project laterally and have resilient blocks.

6. A module carrier as claimed in claim 1, wherein the side parts further comprise lateral slots for receiving a blower frame for a fan driven by an electric motor.

7. A module carrier as claimed in claim 1, further comprising plural attachment members for a vehicle fan shroud.

8. A module carrier as claimed in claim 7, wherein the attachment members are provided on the lower part and on the side parts.

9. A module carrier as claimed in claim 1, further comprising a power-steering cooler fitted in the area of the lower part.

10. A module carrier as claimed in claim 1, further comprising an integrally-molded compartment in the lower area for accommodating a charge-air/air cooler.

11. A module carrier as claimed in claim 1, wherein the vertically projecting side parts have a configuration in the area of the coolant/air cooler and of the air-conditioning condenser that forms a labyrinth system, for preventing air flowing around the two heat exchangers.

12. A module carrier as claimed in claim 10, wherein the compartment has a configuration that prevents air flowing around the charge-air/air cooler.

13. A cooling module for use in a vehicle having a heat-generating power plant, a fan driven by the power plant and a forward grille, the cooling module comprising:

a carrier module as defined by claim 7; and a fan shroud attached to said attachment members on the module carrier, for surrounding the fan, thereby enabling use of a duct extending from the grille to the fan shroud for preventing air from bypassing the module.

14. In a motor vehicle having a heat-generating power plant, a fan driven by the power plant, and a forward grille, a cooling module comprising a carrier module as claimed in claim 7; a coolant/air cooler and an air-conditioning condenser mounted in the carrier module; and a fan shroud attached to the attachment members on the module carrier, for surrounding the fan.

* * * * *